US008752515B2

(12) United States Patent
Yamanaka et al.

(10) Patent No.: US 8,752,515 B2
(45) Date of Patent: Jun. 17, 2014

(54) VARIABLE VALVE TIMING CONTROL APPARATUS OF INTERNAL COMBUSTION ENGINE

(75) Inventors: Atsushi Yamanaka, Atsugi (JP); Naoki Kokubo, Hiratsuka (JP); Ryo Tadokoro, Atsugi (JP); Shinichi Kawada, Isehara (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 131 days.

(21) Appl. No.: 13/443,927

(22) Filed: Apr. 11, 2012

(65) Prior Publication Data

US 2012/0312259 A1 Dec. 13, 2012

(30) Foreign Application Priority Data

Jun. 7, 2011 (JP) ..... 2011-127244

(51) Int. Cl.
*F01L 1/14* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

2010/0269770 A1 10/2010 Kokubo et al.

FOREIGN PATENT DOCUMENTS

JP 2010-255543 11/2010

*Primary Examiner* — Zelalem Eshete
(74) *Attorney, Agent, or Firm* — Antonelli, Terry, Stout & Kraus, LLP.

(57) ABSTRACT

A variable valve timing control apparatus has a drive rotary member, a driven rotary member fixed to a camshaft, an electric motor relatively rotating a motor drive shaft with respect to the drive rotary member, a speed reduction mechanism transmitting rotation of the motor drive shaft to the driven rotary member a housing connected integrally with the drive rotary member and housing therein the electric motor, a cover member fixed to an engine so as to cover at least a front end part of the housing, a power feed mechanism having a slip ring and a power-feed brush that touches the slip ring and feeding power to the electric motor, and a ring-shaped member. The ring-shaped member is fixed to either one side of the cover member and the motor drive shaft, and makes sliding contact with the other side of the cover member and the motor drive shaft.

18 Claims, 8 Drawing Sheets

VARIABLE VALVE TIMING CONTROL APPARATUS OF INTERNAL COMBUSTION ENGINE

BACKGROUND OF THE INVENTION

The present invention relates to a variable valve timing control apparatus of an internal combustion engine, which variably controls open and closing timing of an intake valve and/or an exhaust valve of the engine using an electric motor.

In recent years, there have been proposed and developed various variable valve timing control apparatuses, which improve control response and controllability of a relative rotational phase conversion between an engine crankshaft and a camshaft by transmitting a turning force of the electric motor to the camshaft through a speed reduction mechanism.

One such variable valve timing control apparatus is disclosed in Japanese Patent Provisional Publication No. 2010-255543 (hereinafter is referred to as "JP2010-255543"). In the variable valve timing control apparatus in JP2010-255543, as a power feed mechanism that feeds power to the electric motor, a power-feed brush provided at the electric motor side always makes sliding contact with a slip ring that is fixed to a cover member of the engine, thereby feeding the power to the electric motor.

SUMMARY OF THE INVENTION

In the variable valve timing control apparatus in JP2010-255543, the slip ring is fixed to the cover member that is a non-rotating side (i.e. the stationary cover member) and the power-feed brush is provided at the electric motor side which rotates for the relative rotational phase conversion, then the power is fed to the electric motor with the power-feed brush making sliding contact with the slip ring all the time. However, in this case, there is a possibility that a contact state between the power-feed brush and the slip ring will become worse due to relatively great vibration in a radial direction caused by an alternating torque that is inputted to the camshaft.

It is therefore an object of the present invention to provide a variable valve timing control apparatus of the internal combustion engine, which is capable of achieving a stable and good contact state between the brush and the slip ring all the time.

According to one aspect of the present invention, a variable valve timing control apparatus of an internal combustion engine, comprises: a drive rotary member to which a turning force is transmitted from an engine crankshaft; a driven rotary member which is fixed to a camshaft and, to which the turning force is transmitted from the drive rotary member; an electric motor which relatively rotates a motor drive shaft with respect to the drive rotary member by application of power; a speed reduction mechanism which transmits rotation of the motor drive shaft to the driven rotary member with the rotation of the motor drive shaft reduced by relatively rotating the motor drive shaft with respect to the drive rotary member; a housing which is connected integrally with the drive rotary member and houses therein the electric motor; a cover member which is fixed to the engine so as to cover at least a front end part of the housing; a power feed mechanism which feeds the power to the electric motor, the power feed mechanism having: (a) a slip ring disposed at either one of the housing front end and the cover member; and (b) a power-feed brush disposed at the other of the housing front end and the cover member and touching the slip ring; and a ring-shaped member which is fixed to either one side of the cover member and the motor drive shaft and makes sliding contact with the other side of the cover member and the motor drive shaft.

According to another aspect of the present invention, a variable valve timing control apparatus of an internal combustion engine, comprises: a drive rotary member to which a turning force is transmitted from an engine crankshaft; a driven rotary member which is fixed to a camshaft and, to which the turning force is transmitted from the drive rotary member; an electric motor which converts a relative rotational phase of the driven rotary member with respect to the drive rotary member by application of power; a housing which is connected integrally with the drive rotary member and houses therein the electric motor; a power feed mechanism which feeds the power to the electric motor, the power feed mechanism having: (a) a slip ring disposed at either one of a housing front end part and a non-rotating member that faces to the housing front end part; and (b) a power-feed brush disposed at the other of the housing front end part and the non-rotating member and touching the slip ring; and a ring-shaped member which is provided at either one side of the non-rotating member and a rotating member rotating with respect to the non-rotating member and elastically makes sliding contact with the other side of the non-rotating member and the rotating member.

According to a further aspect of the invention, a variable valve timing control apparatus of an internal combustion engine, comprises: a drive rotary member to which a turning force is transmitted from an engine crankshaft; a driven rotary member which is fixed to a camshaft and, to which the turning force is transmitted from the drive rotary member; an electric motor which converts a relative rotational phase of the driven rotary member with respect to the drive rotary member by application of power; a housing which is connected integrally with the drive rotary member and houses therein the electric motor; a power feed mechanism which feeds the power to the electric motor, the power feed mechanism having: (a) a slip ring disposed at either one of a housing front end part and a non-rotating member that faces to the housing front end part; and (b) a power-feed brush disposed at the other of the housing front end part and the non-rotating member and touching the slip ring; and a ring-shaped member which is provided at either one side of the non-rotating member and a motor drive shaft of the electric motor relatively rotating with respect to the housing and makes sliding contact with the other side of the non-rotating member and the motor drive shaft while elastically pressing the other side.

The other objects and features of this invention will become understood from the following description with reference to the accompanying drawings.

DETAILED DESCRIPTION OF THE INVENTION

According to the present invention, even if the great vibration occurs, it is possible to achieve the stable and good contact state between the brush and the slip ring all the time.

Embodiments of a variable valve timing control apparatus of the present invention will now be explained below with reference to the drawings. In the following description, the variable valve timing control apparatus is applied to a variable valve system for an intake valve side of an internal combustion engine. However, it can also be applied to the variable valve system for an exhaust valve side of the internal combustion engine.

[First Embodiment]

Figure 2:
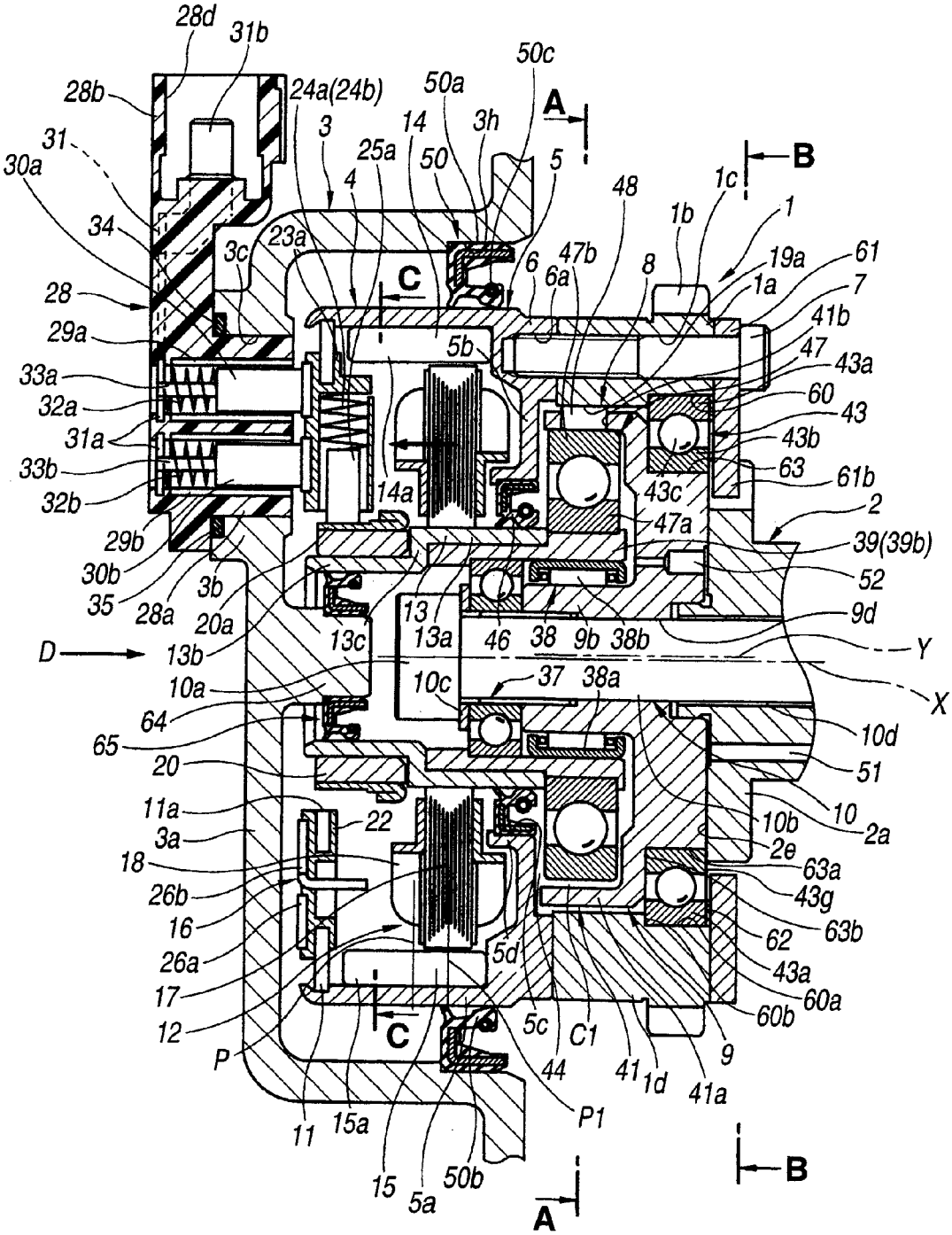
FIG. 2 is a longitudinal cross section of the variable valve timing control apparatus of the first embodiment.
Figure 3:
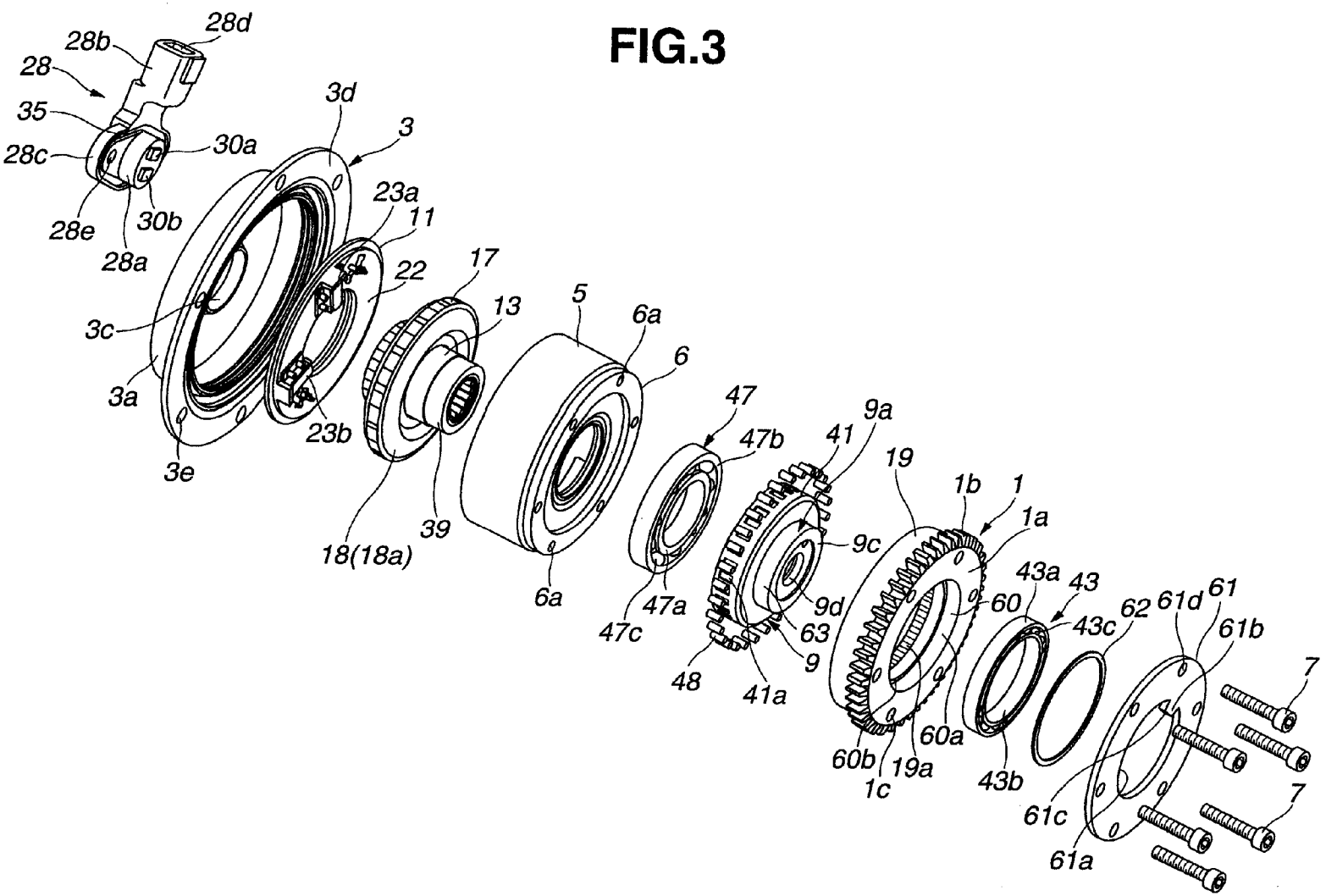
FIG. 3 is a perspective exploded view showing main components of the present embodiment.

As shown in FIGS. 2 and 3, the variable valve timing control apparatus has a timing sprocket 1 as a drive rotary member which is driven and rotates by an engine crankshaft, a camshaft 2 which is rotatably supported on a cylinder head (not shown) of the engine through a bearing (not shown) and rotates by a rotation driving force or turning force transmitted from the timing sprocket 1, a cover member 3 as a non-rotating member (a stationary member) which is positioned at a front side of the timing sprocket 1 and fixed to a chain cover (not shown), and a phase-change mechanism or phase converter 4 which is disposed between the timing sprocket 1 and the camshaft 2 and changes or controls a relative rotational phase (a relative rotational angle position) between the timing sprocket 1 and the camshaft 2 in accordance with an engine operating state.

The timing sprocket 1 is formed as an integral part by iron type metal and has a ring shape. As can be seen in FIG. 3, the timing sprocket 1 has a sprocket body 1*a* whose inner circumferential surface has a stepped shape, a gear portion 1*b* formed integrally with an outer circumference of the sprocket body 1*a* and receiving a rotation driving force or turning force from the engine crankshaft with a timing chain (not shown) wound around the gear portion 1*b*, and an annular member 19 formed integrally with a front end side of the sprocket body 1*a*.

Between the sprocket body 1*a* of the timing sprocket 1 and an after-mentioned driven member 9 which is a driven rotary member and is provided at a front end part of the camshaft 2, a large diameter ball bearing 43 is installed. The timing sprocket 1 and the camshaft 2 are relatively rotatably supported by this large diameter ball bearing 43.

The large diameter ball bearing 43 has a typical structure. As shown in FIGS. 2 and 3, the large diameter ball bearing 43 has an outer ring 43*a*, an inner ring 43*b* and balls 43*c* provided between the outer and inner rings 43*a* and 43*b*. The outer ring 43*a* of this large diameter ball bearing 43 is fixed to an inner circumferential side of the sprocket body 1*a*, whereas the inner ring 43*b* is fixed to an outer circumferential side of the driven member 9.

The sprocket body 1*a* has, at the inner circumferential side thereof, an outer ring fixing portion 60 which is formed into an annular groove shape by the cutting and opens to the camshaft 2 side.

As seen in FIGS. 2 and 3, this outer ring fixing portion 60 is formed into the stepped shape as mentioned above, and has an annular inner circumferential surface 60*a* that extends in an axial direction of the camshaft 2 and a first fixing stepped surface 60*b* that is formed, at an opposite side to the opening of the inner circumferential surface 60*a*, integrally with the sprocket body is in a radial direction. The outer ring 43*a* of the large diameter ball bearing 43 is press-fitted to the inner circumferential surface 60*a* from the axial direction. An inner end surface 43*d* in the axial direction of the press-fitted outer ring 43*a* touches or is contiguous to the first fixing stepped surface 60*b*, then positioning in the axial direction of the outer ring 43*a* is made.

The annular member 19 is formed integrally with an outer circumferential side on the front end side of the sprocket body 1*a*, and has a cylindrical shape that extends toward an electric motor 12 of the phase-change mechanism 4, as can be seen in FIGS. 2 and 3. Further, the annular member 19 has, at an inner circumference thereof, waveform internal teeth 19*a*. These internal teeth 19*a* are continuously arranged at regular intervals in a circumferential direction. At a front end side of the internal teeth 19*a*, an annular female screw forming part 6 is located. The female screw forming part 6 is formed integrally with an after-mentioned housing 5 that houses therein the electric motor 12.

At a rear end side of the sprocket body is which is an opposite side to the annular member 19, an annular retaining plate 61 is located. This retaining plate 61 is formed as an integral part by a metal plate. An outside diameter of the retaining plate 61 is set to be substantially same as an outside diameter of the sprocket body 1*a*. An inside diameter of the retaining plate 61 is set to a diameter of substantially midpoint in the radial direction of the large diameter ball bearing 43.

Figure 5:
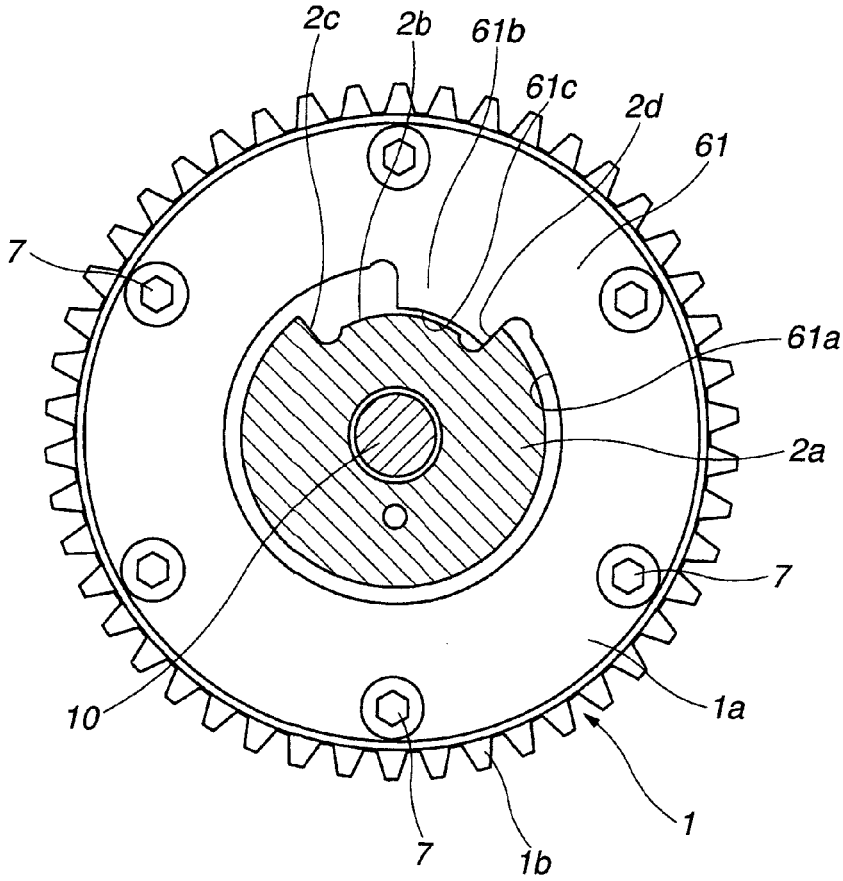
FIG. 5 is a sectional view, viewed from B-B of FIG. 2.

Thus, an inner circumferential part 61*a* of the retaining plate 61 is set so as to face and cover an outer end surface 43*e* in the axial direction of the outer ring 43*a* with a slight gap provided between the outer end surface 43*e* and the inner circumferential part 61*a*. As shown in FIGS. 2, 3 and 5, a stopper protrusion 61*b* is formed integrally with the inner circumferential part 61*a* at a certain position of an inner circumferential edge of the inner circumferential part 61*a*. The stopper protrusion 61*b* protrudes in a radially inward direction, i.e. in a direction of a center, and has a substantially sector or fan shape. A top end edge 61*c* of the stopper protrusion 61*b* is formed into such arc shape that the top end edge 61*c* (the retaining plate 61) slides or rotates along an arc-shaped inner peripheral surface of an after-mentioned stopper recessed groove 2*b* of the camshaft 2. Further, six bolt insertion holes 61*d* into which each bolt 7 is inserted are formed at regular intervals in the circumferential direction at an outer peripheral side of the retaining plate 61.

In addition, a ring-shaped spacer 62 is set between an inner surface of the retaining plate 61 and the outer end surface 43*e* of the outer ring 43*a* of the large diameter ball bearing 43. This spacer 62 serves to give a slight pressing force from the inner surface of the retaining plate 61 to the outer end surface 43*e* of the outer ring 43*a* when tightening and fixing the retaining plate 61 with each of the bolts 7. A thickness of this spacer 62 is set to such thickness that the slight gap within an axial direction movement allowable range of the outer ring 43*a* is provided between the outer end surface 43*e* of the outer ring 43*a* and the retaining plate 61.

As mentioned above, the retaining plate 61 is provided with the six bolt insertion holes 61*d* at regular intervals in the circumferential direction at the outer peripheral side of the retaining plate 61. Also the sprocket body 1*a* (the annular member 19) is provided with six bolt insertion holes is at regular intervals in the circumferential direction at an outer peripheral side of the sprocket body 1*a*. The above-described female screw forming part 6 is provided with six female screw holes 6*a* at positions corresponding to each of the bolt insertion holes 1c and 61*d*. The retaining plate 61, the timing sprocket 1 and the female screw forming part 6 (the housing 5) are tightened and connected together with the six bolts 7 inserting and screwing into these holes.

Here, the sprocket body 1*a* and the annular member 19 serves as a casing of an after-mentioned speed reduction mechanism 8.

As seen in FIGS. 2 and 3, outside diameters of the sprocket body 1*a*, the annular member 19, the retaining plate 61 and the female screw forming part 6 are set to be substantially same as each other.

The cover member 3 is formed as an integral part by aluminium alloy. The cover member 3 has a cup-shaped bulging portion 3*a* at a front end part of the cover member 3 and a cylindrical wall 3*b* that is formed along the axial direction at an outer peripheral side of the bulging portion 3*a*. The cup-shaped bulging portion 3*a* is formed so as to cover a front end part of the housing 5, and bulging portion 3*a* and the cylindrical wall 3*b* are formed integrally with each other (integrally with the cover member 3). As can be seen in FIGS. 2 and 3, the cylindrical wall 3*b* has, at an inner side thereof, a supporting opening 3*c*. As will be described later, an inner circumferential surface of this supporting opening 3*c* acts as a guide surface of an after-mentioned brush retainer 28.

Figure 1:
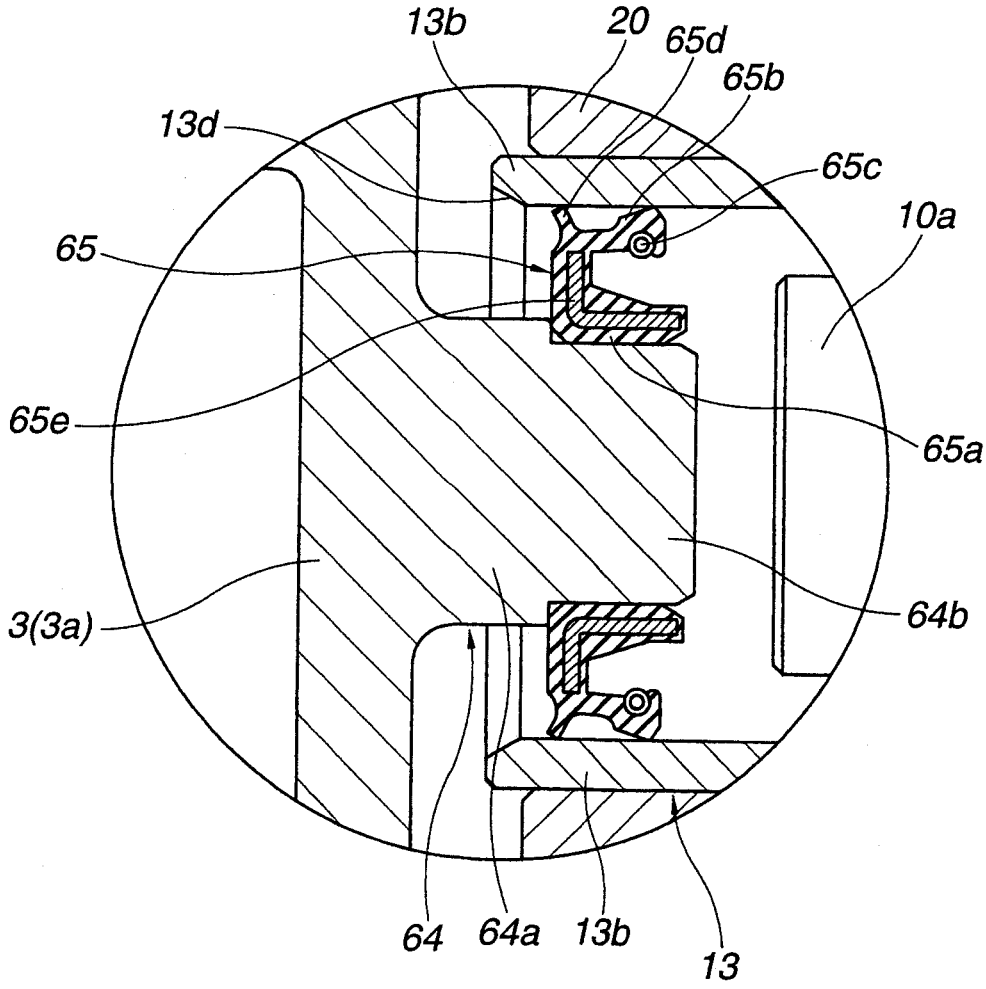
FIG. 1 is an enlarged sectional view of a part, which is a main part of the present invention, of a variable valve timing control apparatus according to a first embodiment.

Further, as shown in FIG. 1, a supporting protuberance 64 is formed integrally with the bulging portion 3*a* at the middle on an inner surface of the bulging portion 3*a*, namely at an opposing position on the inner surface of the bulging portion 3*a* to a top end portion of an after-mentioned cylindrical motor drive shaft 13 in the axial direction. The supporting protuberance 64 is a solid cylindrical column, and protrudes inward from a base portion 64*a* on the inner surface of the bulging portion 3*a* to the axial direction of the motor drive shaft 13. A top end portion 64*b* of the supporting protuberance 64 is formed into a stepped shape whose diameter is smaller than that of the base portion 64*a*.

The cover member 3 has also a flange portion 3*d* at an outer circumference of the cover member 3. The flange portion 3*d* is provided with six bolt insertion holes 3*e*, and the cover member 3 is fixed to the chain cover with bolts (not shown) inserting into these six bolt insertion holes 3*e*.

As shown in FIG. 2, an inner circumferential surface of the bulging portion 3*a*, located at a border with the flange portion 3*d*, has a stepped portion. Then, between this stepped portion of the bulging portion 3*a* and an outer circumferential surface of the housing 5, a large diameter oil seal 50 that is a second ring-shaped member is fitted.

This large diameter oil seal 50 has an almost square bracket ("]") shape in cross section. A base material of the large diameter oil seal 50 is a synthetic rubber, and a core metal is embedded in the synthetic rubber base material. A ring-shaped base portion 50*a* at an outer circumferential side of the large diameter oil seal 50 is press-fitted into a stepped annular portion 3*h* formed on the inner circumferential surface of the cover member 3. Further, an elastic seal portion 50*b* at an inner circumferential side of the large diameter oil seal 50 slidably makes elastic contact with the outer circumferential surface of the housing 5 by a spring force of a backup ring 50*c*.

The housing 5 has a housing body 5*a* formed into a bottomed cylindrical shape by the press forming of iron type metal and a sealing plate 11 sealing or closing a front end opening of the housing body 5*a*.

The housing body 5*a* has a discoid bottom portion 5*b* and a protruding portion 5*d* at a rear end side of the housing body 5*a*. The discoid bottom portion 5*b* is provided, in the middle thereof, with a large diameter shaft part insertion hole 5*c* into which the motor drive shaft 13 and an after-mentioned eccentric shaft part 39 are inserted. The protruding portion 5*d* is formed integrally with a hole edge of the shaft part insertion hole 5*c*, and has a cylindrical shape that protrudes in the axial direction of the camshaft 2. The above-mentioned female screw forming part 6 is formed integrally with an outer circumferential side of a rear end surface of the bottom portion 5*b*.

The camshaft 2 has, at an outer periphery thereof, two driving cams per cylinder, each of which actuates an intake valve (not shown). Further, a flange part 2*a* is formed integrally with a front end portion of the camshaft 2.

As shown in FIGS. 2 and 3, this flange part 2*a* is formed so that its outside diameter is slightly greater than an outside diameter of a fixed end part 9*a* of the driven member 9. More specifically, the flange part 2*a* is set so that an outer circumference of a front end surface 2*e* of the flange part 2*a* touches or is contiguous to an axial direction outer end surface 43*g* of the inner ring 43*b* of the large diameter ball bearing 43 after assembly of each component. Then, the camshaft 2 and the driven member 9 are connected together in the axial direction with a cam bolt 10 with the front end surface 2*e* of the flange part 2*a* being contiguous to the driven member 9 from the axial direction.

As shown in FIG. 5, the flange part 2*a* is provided, at the outer circumference thereof, with the stopper recessed groove 2*b*. The stopper recessed groove 2*b* is formed along the circumferential direction of the flange part 2*a*, and the stopper protrusion 61*b* of the retaining plate 61 is inserted in the stopper recessed groove 2*b* and slides or rotates along the circumferential direction. This arc-shaped stopper recessed groove 2*b* has a predetermined length in the circumferential direction, and both edges of the stopper protrusion 61*b* rotating within a range of this length in the circumferential direction touch respective opposing edges 2*c* and 2*d*, thereby limiting the rotational angle position of the camshaft 2 relative to the timing sprocket 1 to a most-advanced angle side and a most-retarded angle side.

Here, the stopper protrusion 61*b* is set so as to separate toward the camshaft 2 side as compared with a portion that is fixed to the outer ring 43*a* of the large diameter ball bearing 43 from an outside in the axial direction, then the stopper protrusion 61*b* and the fixed end part 9*a* of the driven member 9 are brought in a non-contact state. Thus interfere with the fixed end part 9*a* (i.e. contact of the stopper protrusion 61*b* and the fixed end part 9*a*) can be adequately suppressed.

The stopper protrusion 61*b* and the stopper recessed groove 2*b* form a stopper mechanism.

As seen in FIG. 2, the cam bolt 10 has a ring-shaped washer part 10*c* provided on an edge surface, at a shaft part 10*b* side, of a bolt head 10*a* and a male screw part 10*d* formed at an outer periphery of the shaft part 10*b*. The male screw part 10*d* is then screwed in a female thread that is formed inside the camshaft 2 from the end portion of the camshaft 2 in the axial direction.

The driven member 9 is formed as an integral part by iron type metal. The driven member 9 has the disc-shaped fixed end part 9*a* at the rear end side of the driven member 9, a cylindrical portion 9*b* that protrudes from an inner peripheral front end surface of the fixed end part 9*a* in the axial direction, and a cylindrical retainer 41 that is formed integrally with an outer circumference of the fixed end part 9*a* and retains a plurality of rollers 48.

The driven member 9 is fixed to the camshaft 2 with a rear end surface 9*c* of the fixed end part 9*a* being contiguous to and press-fitted to the front end surface 2*e* of the flange part 2*a* of the camshaft 2 from the axial direction by an axial force of the cam bolt 10.

The cylindrical portion 9*b* is provided, in the middle thereof, with an insertion hole 9*d* into which the shaft part 10*b* of the cam bolt 10 is inserted. The cylindrical portion 9*b* is also provided, at an outer circumference side thereof, with a needle bearing ring 38.

Figure 4:
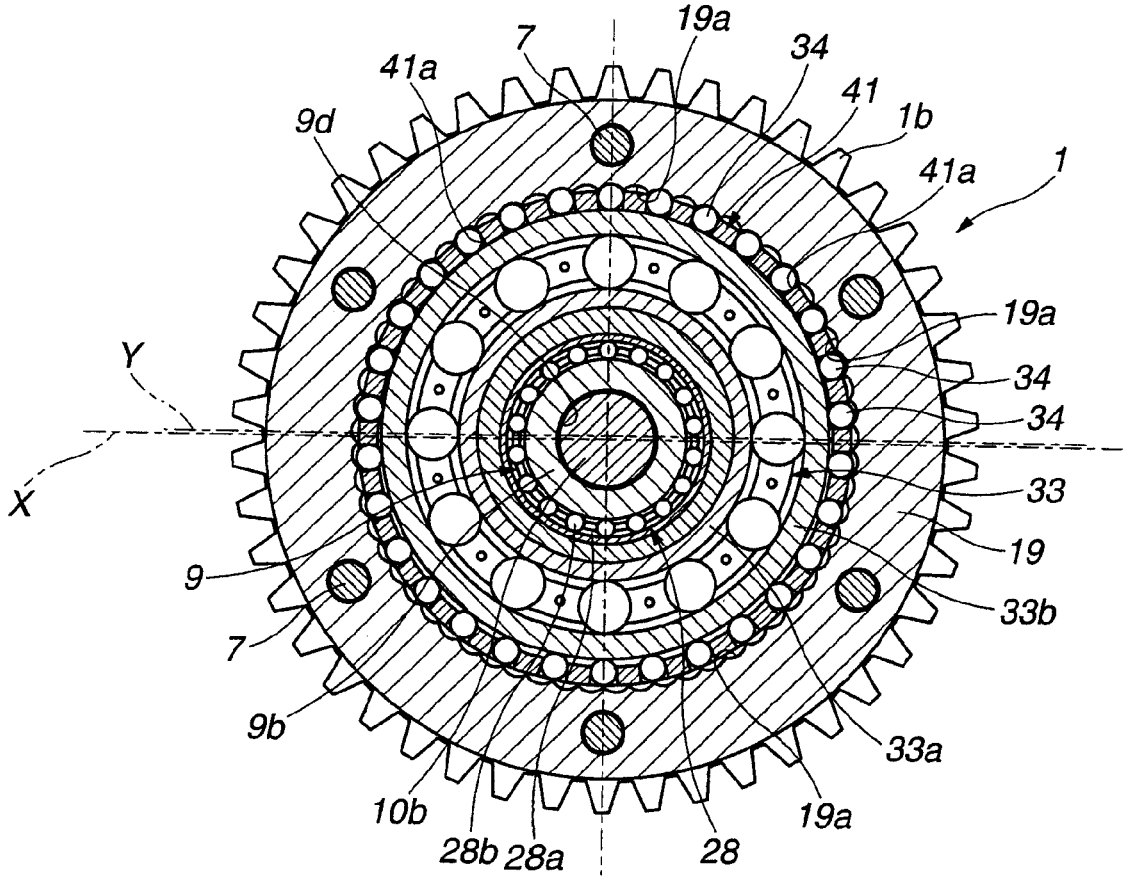
FIG. 4 is a sectional view, viewed from A-A of FIG. 2.

As shown in FIGS. 2 to 4, the retainer 41 is shaped like a letter "L" in cross section by being bent from the outer circumference front end of the fixed end part 9*a*, and has a bottomed cylindrical shape protruding in the same direction as the cylindrical portion 9*b*. A tubular or cylindrical top end portion 41*a* of the retainer 41 extends toward the bottom portion 5*b* of the housing 5 through a space 44 that is a ring-shaped recessed portion formed between the female screw forming part 6 and the protruding portion 5*d*. Further, a plurality of substantially rectangular roller retaining holes 41*b* are formed at regular intervals in a circumferential direction of the top end portion 41*a*. The retaining holes 41*b* is a roller retaining portion that retains a plurality of the rollers 48 so that each roller 48 can roll. The number of the all retaining holes 41*b* (the rollers 48) is set to be less than that of the internal teeth 19*a* of the annular member 19 by one.

As can be seen in FIGS. 2 and 3, between the outer circumference of the fixed end part 9*a* and a bottom side connecting portion of the retainer 41, an inner ring fixing portion 63 for fixing the inner ring 43*b* of the large diameter ball bearing 43 is formed by the cutting.

More specifically, this inner ring fixing portion 63 is formed into a stepped shape at a position opposite to the outer ring fixing portion 60 in the radial direction. The inner ring fixing portion 63 has an annular outer circumferential surface 63*a* that extends in the axial direction of the camshaft 2 and a second fixing stepped surface 63*b* that is formed integrally with the annular outer circumferential surface 63*a* along the radial direction. The inner ring 43*b* of the large diameter ball bearing 43 is press-fitted to the outer circumferential surface 63*a* from the axial direction, and an inner end surface 43*f* of the press-fitted inner ring 43*b* is contiguous to the second fixing stepped surface 63*b*, thereby achieving the positioning in the axial direction of the large diameter ball bearing 43.

The phase-change mechanism 4 has the electric motor 12 acting as an actuator which is substantially coaxially aligned with the camshaft 2 at a front end side of the camshaft 2 and the speed reduction mechanism 8 which reduces a rotation speed of the electric motor 12 and transmits it to the camshaft 2.

The electric motor 12 is a brush DC motor, and has the housing 5 that is a yoke rotating integrally with the timing sprocket 1, the motor drive shaft 13 that is a rotary member rotatably provided inside the housing 5, a pair of semi-arc permanent magnets 14 and 15 that are stators secured to an inner peripheral surface of the housing 5, and a stator 16 that is secured to the sealing plate 11.

The motor drive shaft 13 is formed into a stepped cylindrical shape as shown in FIG. 2, and functions as an armature. The motor drive shaft 13 has a large diameter portion 13*a* positioned at the camshaft 2 side, a small diameter portion 13*b* positioned at the brush retainer 28 side, i.e. at a top end side of the motor drive shaft 13, and a stepped portion 13*c* positioned in a midpoint in the axial direction of the motor drive shaft 13. An iron-core rotor 17 is secured to an outer periphery of the large diameter portion 13*a*. The eccentric shaft part 39 is press-fitted into and fixed to an inside of the large diameter portion 13*a* from the axial direction, and further a position in the axial direction of the eccentric shaft part 39 is fixed by an inner surface of the stepped portion 13*c*.

On the other hand, a current switching commutator 20 having at an outer circumference thereof a slip ring 20*a* is press-fitted onto and fixed to an outer periphery of the small diameter portion 13*b*, and further a position in the axial direction of the commutator 20 is fixed by an outer surface of the stepped portion 13*c*.

In this manner, since both positioning in the axial direction of the eccentric shaft part 39 and the commutator 20 can be made by the inner and outer surfaces of the stepped portion 13*c*, this facilitates the assembly and improves positioning accuracy.

Further, as shown in FIG. 1, a ring-shaped tapered surface 13*d* whose diameter becomes wider in an outward direction is formed at a top end inner peripheral edge of the small diameter portion 13*b* of the motor drive shaft 13.

Moreover, a part of the base portion 64*a* and the whole of the top end portion 64*b* of the supporting protuberance 64, which are formed integrally with the cover member 3, are inserted and positioned in the small diameter portion 13*b*. Between an outer peripheral surface of the top end portion 64*b* and an inner peripheral surface of the small diameter portion 13*b* of the motor drive shaft 13, a first oil seal 65 that is a ring-shaped member (a first ring-shaped member) is fitted.

As can be seen from FIGS. 1 and 2, the first oil seal 65 whose base material is rubber has an almost square bracket ("]") shape in cross section. The first oil seal 65 has an inner peripheral base portion 65*a*, an elastic seal portion 65*b*, a backup ring 65*c* and a seal lip 65*d*. The inner peripheral base portion 65*a* is press-fixed to the outer periphery of the top end portion 64*b*. The elastic seal portion 65*b* is formed integrally with a front side edge of the inner peripheral base portion 65*a*, and slidably makes elastic contact with the inner peripheral surface of the small diameter portion 13*b*. The backup ring 65*c* forces the elastic seal portion 65*b* toward the inner peripheral surface of the small diameter portion 13*b*. The seal lip 65*d* is formed integrally with a front edge outer periphery of the elastic seal portion 65*b*, and makes elastic contact with the inner peripheral surface of the small diameter portion 13*b*. Further, a core metal 65*e* is embedded in the inner peripheral base portion 65*a*.

Upon the assembly of each component, the inner peripheral base portion 65*a* of the first oil seal 65 is previously press-fitted and fixed to the top end portion 64*b* of the supporting protuberance 64 of the cover member 3. Further, when the cover member 3 is fixed to the engine, the elastic seal portion 65*b* is elastically slid to the inner peripheral surface of the small diameter portion 13*b* of the motor drive shaft 13 with the top end tapered surface 13*d* being a guide, then finally, the whole of the first oil seal 65 is fitted and housed between the top end portion 64*b* of the cover member 3 and the small diameter portion 13*b* of the motor drive shaft 13.

The first oil seal 65 having the above structure prevents leakage of lubricating oil from an inside of the motor drive shaft 13 into the housing 5 through the elastic seal portion 65*b*, also gives a rotational load to the motor drive shaft 13 by a frictional resistance (a frictional drag) with the first oil seal 65 making sliding contact with the inner peripheral surface of the small diameter portion 13*b* of the rotating motor drive shaft 13.

The iron-core rotor 17 is formed by magnetic member having a plurality of magnetic poles, and an electromagnetic coil 18 is wound around a slot that is formed at an outer peripheral of the iron-core rotor 17. The electromagnetic coil 18 is disposed at a position close to a front end surface of the bottom portion 5*b* of the housing 5 from the axial direction with a coil part 18*a* at the camshaft 2 side housed in a recessed portion 5*e* of the front end surface of the bottom portion 5*b*.

On the other hand, as for the commutator 20, the electromagnetic coil 18 is electrically connected to each of segments of the commutator 20 which are divided into the same number of the magnetic poles of the iron-core rotor 17.

Each of the permanent magnets 14 and 15 has a cylindrical shape, and has a plurality of magnetic poles in the circumferential direction. As can be seen in FIG. 2, a position in the axial direction of each of the permanent magnets 14 and 15 is offset forward (toward a left hand side in FIG. 2) from a fixed position of the iron-core rotor 17.

More specifically, a center P in the axial direction of each of the permanent magnets 14 and 15 is offset in the forward direction, i.e. toward the stator 16 side, with respect to a center P1 in the axial direction of the iron-core rotor 17 by a predetermined distance α.

With this arrangement, front end portions 14*a* and 15*a* of the permanent magnets 14 and 15 radially overlap the commutator 20 and after-mentioned switching brushes 25*a* and 25*b* (first brushes 25*a* and 25*b*, see FIG. 6) of the stator 16.

Figure 6:
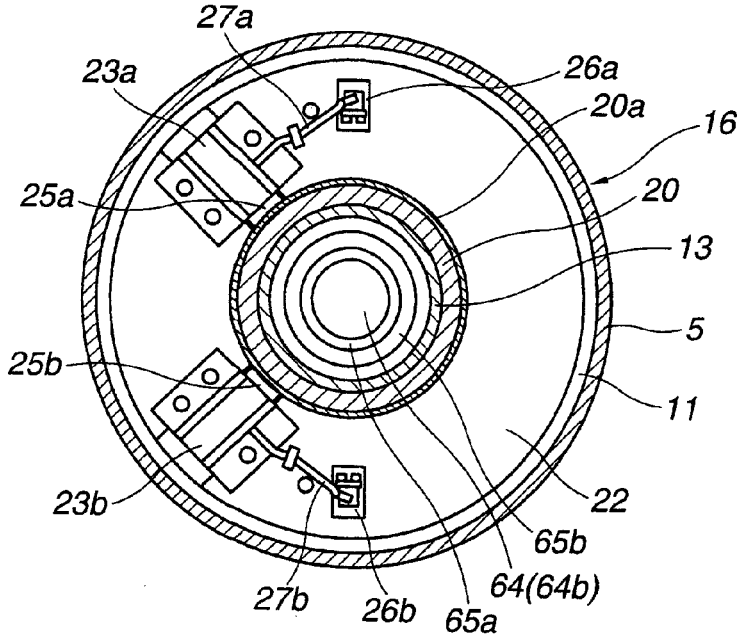
FIG. 6 is a sectional view, viewed from C-C of FIG. 2.

The stator 16 has, as shown in FIGS. 2, 3 and 6, a disc-shaped resin plate 22 formed integrally with an inner peripheral side of the sealing plate 11, a pair of resin holders 23*a*, 23*b* provided on an inner side of the resin plate 22, the switching brushes 25*a*, 25*b*, inside-outside-double ring-shaped slip rings 26*a*, 26*b* embedded in and fixed to front end surfaces of the resin holders 23*a*, 23*b* with each outer end surface of the slip rings 26*a*, 26*b* exposed, and pigtail harnesses 27*a*, 27*b* electrically connecting the switching brushes 25*a*, 25*b* and the slip rings 26*a*, 26*b* respectively. The switching brushes 25*a*, 25*b* are commutators, and are housed in the resin holders 23*a*, 23*b* so as to be able to slide along the radial direction. Each top end surface of the switching brushes 25*a*, 25*b* makes elastic contact with the outer circumference of the commutator 20 from the radial direction by spring forces of coil springs 24*a*, 24*b*.

Here, the slip rings 26*a*, 26*b* form a part of a power feed mechanism. The switching brushes 25*a*, 25*b*, the commutator 20 and the pigtail harnesses 27*a*, 27*b* etc. form a current switching mechanism.

A position of the sealing plate 11 is fixed by a recessed stepped portion that is formed at the front end part inner periphery of the housing 5, then the sealing plate 11 is fixed to the front end part inner periphery of the housing 5 by the crimping. The sealing plate 11 is provided, in the middle thereof, with a shaft insertion hole 11*a* into which one end portion of the motor drive shaft 13 is inserted.

The brush retainer 28 molded as an integral part by synthetic resin material is fixed to the supporting opening 3*c* of the bulging portion 3*a* of the cover member 3.

Figure 7:
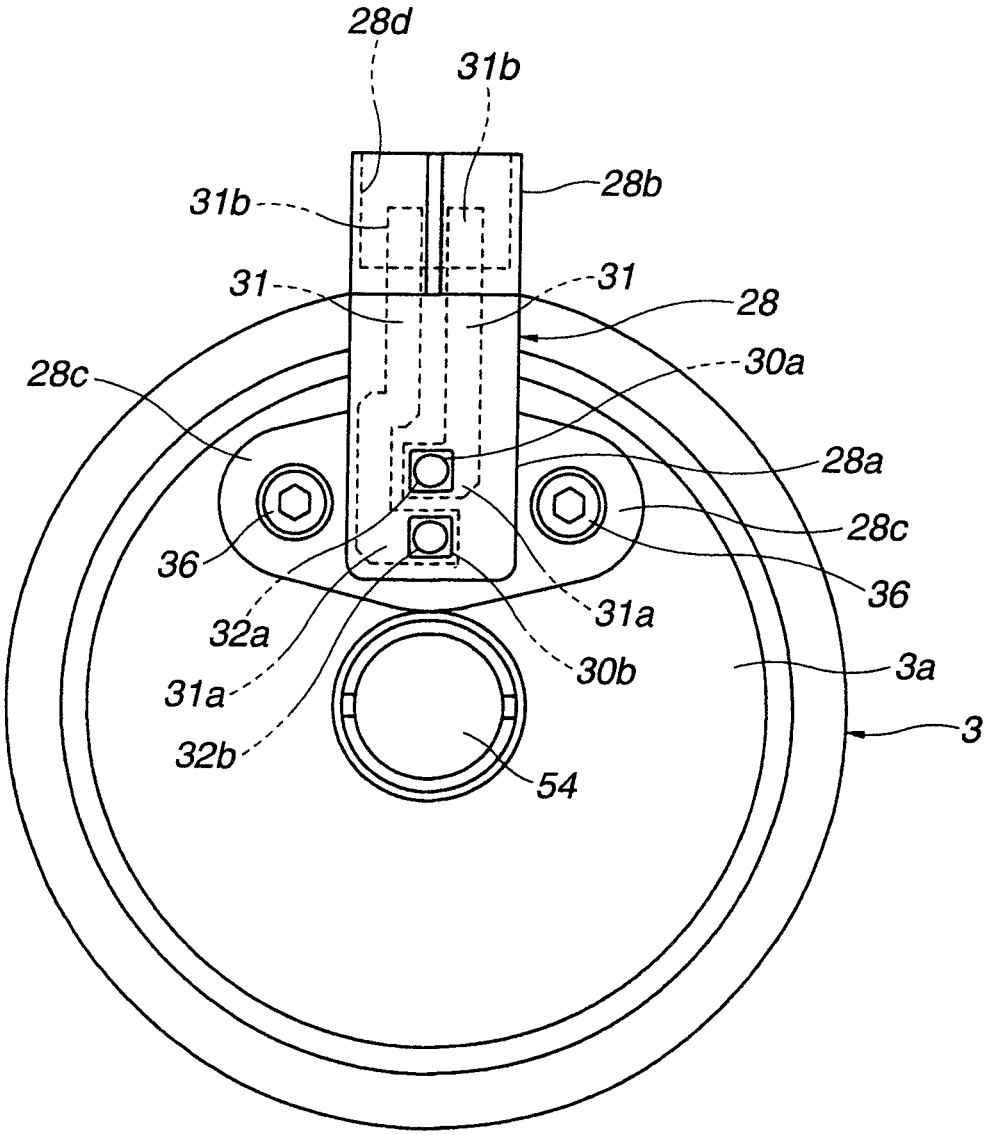
FIG. 7 is a drawing, viewed from an arrow of D in FIG. 2.

As shown in FIGS. 2, 3 and 7, this brush retainer 28 has an L-shape when viewed from a side. The brush retainer 28 has a substantially cylindrical brush retaining part 28*a* that is inserted into the supporting opening 3*c*, a connector part 28*b* that is positioned at an upper end portion of the brush retaining part 28*a*, a pair of brackets 28*c*, 28*c* that are formed integrally with both sides of the brush retaining part 28*a* and fixed to the bulging portion 3*a*, and a pair of terminal parts 31, 31, most of which are embedded in the brush retainer 28.

A pair of the terminal parts 31, 31 are arranged parallel to each other in up-and-down direction, and has a crank-shape, as shown in FIG. 7. Terminals 31*a*, 31*a* provided at one side (a lower end side) are located at a bottom side of the brush retaining part 28*a* with each terminal 31*a* exposed. Terminals 31*b*, 31*b* provided at the other side (an upper end side) are formed in a female fitting groove 28*d* of the connector part 28*b*. The other side terminals 31*b*, 31*b* are electrically connected to a battery power via a male terminal (not shown).

As shown in FIG. 2, the brush retaining part 28*a* extends in a horizontal direction (in the axial direction), and sleeve-shaped sliding parts 29*a*, 29*b* are fixed in a cylindrical penetration opening that is formed at up-and-down position inside the brush retaining part 28*a*. Power-feed brushes 30*a*, 30*b* (second brushes 30*a*, 30*b*) are held in the sliding parts 29*a*, 29*b* so as to be able to slide in the axial direction. Top end surfaces of these power-feed brushes 30*a*, 30*b* touch or are contiguous to the slip rings 26*a*, 26*b* respectively from the axial direction by the sliding movement of the power-feed brushes 30*a*, 30*b*.

Each of the power-feed brushes 30*a*, 30*b* is formed into a substantially rectangular parallelepiped. The power-feed brushes 30*a*, 30*b* are respectively forced toward the slip rings 26*a*, 26*b* by spring forces of second coil springs 32*a*, 32*b* that are forcing or urging members elastically installed between the one side terminals 31*a*, 31*a* and the power-feed brushes 30*a*, 30*b*.

As shown in FIG. 1, a pair of bendable pigtail harnesses 33*a*, 33*b* are fixed between rear end portions of the power-feed brushes 30*a*, 30*b* and the one side terminals 31*a*, 31*a* by the welding, then both of the power-feed brushes 30*a*, 30*b* and the one side terminals 31*a*, 31*a* are electrically connected to each other. Each length of the pigtail harnesses 33*a*, 33*b* is set to such length that when the power-feed brushes 30*a*, 30*b* move forward (toward a right hand side in FIG. 2) to the maximum by the coil springs 32*a*, 32*b*, the power-feed brushes 30*a*, 30*b* do not come out or fall out of the sliding parts 29*a*, 29*b*. That is, each length of the pigtail harnesses 33*a*, 33*b* is set to the length that limits a maximum sliding position of each of the power-feed brushes 30*a*, 30*b*.

Further, a ring-shaped seal member 34 is fitted and supported in an annular fitting groove formed at a base side outer periphery of the brush retaining part 28*a*. Then when the brush retaining part 28*a* is inserted into the supporting opening 3*c*, the seal member 34 seals an inside of the brush retainer 28 with the seal member 34 making elastic contact with a top end surface of the cylindrical wall 3*b* of the cover member 3.

The male terminal (not shown) is inserted and fitted into the female fitting groove 28*d* at the upper end side. The other side terminals 31*b*, 31*b*, positioned in the female fitting groove 28*d*, of the connector part 28*b* are then electrically connected to a control unit (not shown) via the male terminal.

Each of the brackets 28*c*, 28*c* is formed into a substantially triangle. The brackets 28*c*, 28*c* have, at both ends thereof, bolt insertion holes 28*e*, 28*e*. Bolts 36, 36 are screwed into a pair of female screw holes 3*f*, 3*f* that are formed at the bulging portion 3*a*. The brush retainer 28 is fixed to the bulging portion 3*a* through the brackets 28*c*, 28*c* with the bolts 36, 36 inserted into the bolt insertion holes 28*e*, 28*e* and screwed into the female screw holes 3*f*, 3*f*.

A small diameter ball bearing 37 is provided on the outer peripheral surface, at the bolt head 10*a* side, of the shaft part 10*b* of the cam bolt 10. The motor drive shaft 13 and the eccentric shaft part 39 are rotatably supported by this small diameter ball bearing 37 and the needle bearing ring 38 provided on the outer circumferential surface of the cylindrical portion 9*b* of the driven member 9 and positioned at a side in the axial direction of the small diameter ball bearing 37. These small diameter ball bearing 37 and needle bearing ring 38 form a bearing mechanism.

The needle bearing ring 38 has a cylindrical retainer 38*a* press-fitted to an inner peripheral surface of the eccentric shaft part 39 and a needle roller 38*b* having a plurality of rollers, each of which is held and rolls in the retainer 38*a*. The needle bearing ring 38 rolls on the outer circumferential surface of the cylindrical portion 9*b* of the driven member 9.

An inner ring of the small diameter ball bearing 37 is supported and fixed between a front end edge of the cylindrical portion 9*b* of the driven member 9 and the washer part 10*c* of the cam bolt 10. An outer ring of the small diameter ball bearing 37 is supported between a stepped portion formed on the inner periphery of the eccentric shaft part 39 and a snap ring 45 that is an anti-falling ring with a position in the axial direction of the outer ring fixed by these stepped portion of the eccentric shaft part 39 and snap ring 45.

As shown in FIG. 2, a second oil seal 46 is provided between the outer peripheral surface of the motor drive shaft 13 (the eccentric shaft part 39) and an inner peripheral surface of the protruding portion 5*d* of the housing 5. The second oil seal 46 prevents leakage of the lubricating oil from an inside of the speed reduction mechanism 8 into an inside of the electric motor 12. A structure of this second oil seal 46 is basically same as that of the first oil seal 65. An outer peripheral base portion of the second oil seal 46 is press-fixed to the inner peripheral surface of the protruding portion 5*d* of the housing 5, and an elastic seal portion at an inner peripheral side of the second oil seal 46 makes elastic contact with the outer peripheral surface of the large diameter portion 13*a* of the motor drive shaft 13, thereby giving a frictional resistance (a frictional drag) to the rotation of the motor drive shaft 13.

The control unit is configured to detect a current engine operating condition on the basis of information signals from sensors such as a crank angle sensor, an airflow meter, an engine temperature sensor and an accelerator opening sensor (all, not shown) then execute an engine control. Also the control unit carries out a rotation control of the motor drive shaft 13 through the application of power to the electromagnetic coil 18, then controls the rotational phase (relative rotational angle position) of the camshaft 2 relative to the timing sprocket 1 through the speed reduction mechanism 8.

The speed reduction mechanism 8 mainly has, as shown in FIGS. 2 and 3, the eccentric shaft part 39 eccentrically rotating, a middle diameter ball bearing 47 provided at an outer periphery of the eccentric shaft part 39, the rollers 48 provided at an outer circumference of the middle diameter ball bearing 47, the retainer 41 allowing a radial movement of the rollers 48 while retaining the rollers 48 in a rolling direction, and the driven member 9 with which the retainer 41 is formed integrally.

The eccentric shaft part 39 is formed into a cylindrical shape having a step, and has a small diameter portion 39*a* at a front end side thereof and a large diameter portion 39*b* at a rear end side thereof. The small diameter portion 39*a* is press-fixed to an inner peripheral surface of the large diameter portion 13*a* of the motor drive shaft 13. An axial center Y of a cam surface that is formed on an outer circumferential surface of the large diameter portion 39*b* is set at a position slightly eccentric to an axial center X of the motor drive shaft 13 in the radial direction. Here, the middle diameter ball bearing 47 and the rollers 48 etc. form a planetary mesh or engagement mechanism.

The middle diameter ball bearing 47 is disposed so as to almost entirely overlap the needle bearing ring 38 in the radial direction. The middle diameter ball bearing 47 has an inner ring 47*a*, an outer ring 47*b* and balls 47*c* provided between the outer and inner rings 47*a* and 47*b*. The inner ring 47*a* is press-fixed to the outer circumferential surface of the eccentric shaft part 39, whereas the outer ring 47*b* is in a free state without being fixed in the axial direction. That is, one end surface in the axial direction, at the electric motor 12 side, of this outer ring 47*b* does not touch any part, also a small first gap C is provided between the other end surface 47*d* in the axial direction of the outer ring 47*b* and an inside surface of the opposing retainer 41. Further, an outer peripheral surface of each of the rollers 48 is contiguous to an outer circumferential surface of the outer ring 47*b* so as to be able to roll. Also a ring-shaped second gap C1 is provided at the outer circumferential side of this outer ring 47*b*. That is, by this second gap C1, the whole of the middle diameter ball bearing 47 can move in the radial direction with and by an eccentric rotation of the eccentric shaft part 39, namely that an eccentric movement of the middle diameter ball bearing 47 becomes possible.

Each of the rollers 48 is fitted to the internal teeth 19*a* of the annular member 19 while moving in the radial direction with and by the eccentric movement of the middle diameter ball bearing 47. Each of the rollers 48 also wobbles in the radial direction while being guided in the circumferential direction by both side edges of the roller retaining holes 41*b* of the retainer 41.

The speed reduction mechanism 8 having the above structure is configured so that the relative rotational phase angle of the driven member 9 (the camshaft 2) is converted to a retarded angle side by the fact that the motor drive shaft 13 of the electric motor 12 rotates in the same direction as a rotational direction of the timing sprocket 1, whereas when a rotation speed of the electric motor 12 decreases and is slower than a rotation speed of the timing sprocket 1, the relative rotational phase angle of the driven member 9 is converted to an advanced angle side.

The speed reduction mechanism 8 is supplied with the lubricating oil by a lubricating oil supplying mechanism. This lubricating oil supplying mechanism has an oil supply passage which is formed at an inside of the bearing of the cylinder head and is supplied with the lubricating oil from a main oil gallery (not shown), and as shown in FIG. 2, an oil supply hole 51 which is formed in the axial direction in the camshaft 2 and communicates with the oil supply passage through a groove, a small diameter oil hole 52 which penetrates the driven member 9 in the axial direction and whose one end opens to the oil supply hole 51 and whose other end opens to an area close to the needle bearing ring 38 and the middle diameter ball bearing 47, and three large diameter oil exhaust holes (not shown) that penetrate the driven member 9.

The lubricating oil is supplied and accumulates in the space 44 by the lubricating oil supplying mechanism, and movable parts or elements such as the middle diameter ball bearing 47 and each roller 48 are sufficiently supplied with the lubricating oil from this space 44. Here, leakage of the lubricating oil accumulating in the space 44 into the housing 5 is prevented by the second oil seal 46.

Further, a first cap 53, having an almost square bracket ("]") shape in cross section, is press-fixed at a front end inner side of the motor drive shaft 13 to close or seal a space portion at the cam bolt 10 side.

Next, working or operation of the present embodiment will be explained. When the crankshaft of the engine rotates, the timing sprocket 1 rotates through the timing chain, and the housing 5 rotates in synchronization with the engine crankshaft and the timing sprocket 1 with the turning force of the timing sprocket 1 transmitted to the housing 5 through the annular member 19 and the female screw forming part 6. On the other hand, the turning force of the annular member 19 is transmitted to the camshaft 2 through each of the rollers 48, the retainer 41 and the driven member 9. With this working, the cam of the camshaft 2 actuates (opens and closes) the intake valve.

In a certain engine operating state after an engine start, the control unit flows the current to the electromagnetic coil 18 of the electric motor 12 through the terminal parts 31, 31, the pigtail harnesses 33*a*, 33*b*, the power-feed brushes 30*a*, 30*b* and the slip rings 26*a*, 26*b* etc. The motor drive shaft 13 is then driven and rotates, and this turning force is transmitted to the camshaft 2 through the speed reduction mechanism 8 with the rotation reduced.

That is, when the eccentric shaft part 39 eccentrically rotates with and by the rotation of the motor drive shaft 13, each of the rollers 48 gets over one certain internal tooth 19*a* of the annular member 19 and moves to the other adjacent internal tooth 19*a* while rolling and being radially guided by each roller retaining hole 41*b* of the retainer 41 every one rotation of the motor drive shaft 13. The rollers 48 rotate in the circumferential direction while rolling and moving to the adjacent internal tooth 19*a* successively or one by one. By this rotation (the rolling and the moving) of each of the rollers 48, the turning force of the motor drive shaft 13 is transmitted to the driven member 9 with the rotation of the motor drive shaft 13 reduced. Here, a speed reducing ratio at this time can be arbitrarily set in accordance with the number of the rollers 48 etc.

With this operation, the camshaft 2 relatively rotates in forward and reverse directions with respect to the timing sprocket 1, then the relative rotational phase is converted, thereby achieving a conversion control of open and closing timing of the intake valve to the advanced angle side or the retarded angle side.

In this embodiment, since the top end portion (the small diameter portion 13*b*) of the motor drive shaft 13 of the electric motor 12 is elastically supported by the cover member 3 through the first oil seal 65, vibrations of whole of the apparatus in the radial direction can be suppressed. It is therefore possible to achieve a stable and good contact state between the power-feed brushes 30*a*, 30*b* and the slip rings 26*a*, 26*b*.

Further, in addition to the suppression of the vibrations in the radial direction, the first oil seal 65 has the function of sealing that suppresses the leakage of the lubricating oil of the speed reduction mechanism 8 from the inside of the top end portion (the small diameter portion 13*b*) of the motor drive shaft 13 toward electric equipment or element such as the first and second brushes 25*a*, 25*b* and 30*a*, 30*b*. It is thus possible to suppress adhesion or deposition of contaminants such as metal powder included in the lubricating oil to or between each brush, the commutator 20 and the slip rings 26*a*, 26*b*. Also an increase in the component count can be suppressed.

Furthermore, the first oil seal 65 is set between the cover member 3 that is a fixed side and the motor drive shaft 13 that is a rotation side. Thus, while the apparatus is rotating, the first oil seal 65 always gives the frictional resistance (the frictional drag) to the motor drive shaft 13. The rotational load by the frictional drag is small, yet the first oil seal 65 gives this small or slight rotational load to the motor drive shaft 13.

Consequently, for example, even if a failure in the electric motor 12 occurs and the current supply from the control unit stops, it is possible for the motor drive shaft 13 to rotate with delay with respect to the rotation of the timing sprocket 1 by the frictional drag at an engine restart. Hence, the relative rotational phase of the driven member 9 through the speed reduction mechanism 8 can be automatically returned to the advanced angle side that is suitable for the engine restart, also a conversion response to the advanced angle side can be improved.

Since the second oil seal 46 also gives the frictional drag to the motor drive shaft 13, this facilitates the conversion operation to the advanced angle side, together with the frictional drag by the first oil seal 65.

Here, by changing the number of the internal teeth 19*a* of the annular member 19, it is possible to operate the relative rotational phase to the retarded angle side while securing the same speed reducing ratio, then the most-retarded angle phase can be set to an initial position of the engine start.

Further, as described above, since the first oil seal 65 is previously fitted to the supporting protuberance 64 of the cover member 3 at the assembly of each component, there is no need to individually attach the first oil seal 65. Also, since the first oil seal 65 can be set inside the motor drive shaft 13 at the same time when fixing the cover member 3 after connecting (screwing) the cam bolt 10, this facilitates the assembly.

Furthermore, when inserting the first oil seal 65 previously fixed at the outer periphery of the supporting protuberance 64 (the top end portion 64*b*) into the motor drive shaft 13 from the top end portion (the small diameter portion 13*b*) of the motor drive shaft 13, the tapered surface 13*d* serves as the insertion guide. The workability of insertion of the elastic seal portion 65*b* of the first oil seal 65 can be improved, and damage to the motor drive shaft 13, the first oil seal 65, the cover member 3 etc. can be prevented.

In addition, in the present embodiment, the center P in the axial direction of each of the permanent magnets 14, 15 is offset in the forward direction with respect to the center P1 in the axial direction of the iron-core rotor 17. Thus, by magnetic force that occurs between the permanent magnets 14, 15 and the iron-core rotor 17, the iron-core rotor 17 is attracted in the forward direction (toward the left hand side in FIG. 2), and the iron-core rotor 17, the motor drive shaft 13 and the eccentric shaft part 39 are constantly attracted in an arrow direction (a bold arrow indicated at the iron-core rotor 17 in FIG. 2). That is, since the magnetic force of the permanent magnets 14, 15 and the magnetic force of the iron-core rotor 17 become the maximum at the axial direction centers P and P1 respectively, an attraction force acting on the iron-core rotor 17 toward the center P of the permanent magnets 14, 15 becomes great, then the iron-core rotor 17, the motor drive shaft 13 and the eccentric shaft part 39 are strongly attracted in the arrow direction.

With this attraction, the small diameter ball bearing 37, the needle bearing ring 38 also the middle diameter ball bearing 47 are attracted in the arrow direction.

As a consequence, it is possible to suppress an occurrence of unusual noises caused by micro-vibrations in the axial direction of each of the ball bearings 37, 47 and the needle bearing ring 38 which occur by an alternating torque occurring at the camshaft 2 by a spring force etc. of a valve spring.

Additionally, by arranging the positions in the axial direction of the permanent magnets 14, 15 to the offset positions, since the front end portions 14*a*, 15*a* of the permanent magnets 14, 15 can overlap the switching brushes 25*a*, 25*b* and the commutator 20, a length in the axial direction of the apparatus can be as small as possible.

Moreover, since the lubricating oil is forcibly supplied in the speed reduction mechanism 8 from the oil supply hole 51 and the small diameter oil hole 52, lubricity of each component in the speed reduction mechanism 8 is improved. Also, since the lubricating oil is supplied between the internal tooth 19*a* and the rollers 48 and to the needle bearing ring 38 and the middle diameter ball bearing 47, lubricity between the needle roller 38*b* and each ball is improved. This allows a smooth rotational phase conversion by the speed reduction mechanism 8 all the time, and brings a shock-absorbing function by the lubricating oil. Noises occurring at each component or each portion can therefore be effectively suppressed.

In particular, since the space 44 is supplied with and filled with the lubricating oil that is pumped out from an oil pump through the lubricating oil supplying mechanism all the time during the engine operation, an occurrence of a shortage in the lubricating oil (insufficient oil film) of each rolling part and sliding part such the ball bearing can be suppressed. Accordingly, it is possible to adequately reduce a drive load of the electric motor 12 at a rotation start, and control response of the valve timing can be improved and energy consumption can be decreased.

Further, the speed reduction mechanism 8 and the electric motor 12 are integrally connected by the housing 5, and also these speed reduction mechanism 8 and electric motor 12 and the timing sprocket 1 are integrally connected by the housing 5 through the sprocket body 1*a*. Therefore, all components are connected as one unit. In addition to the size reduction in the axial direction, a size in the radial direction of the apparatus can be reduced, and this facilitates product control.

[Second Embodiment]

Figure 8:
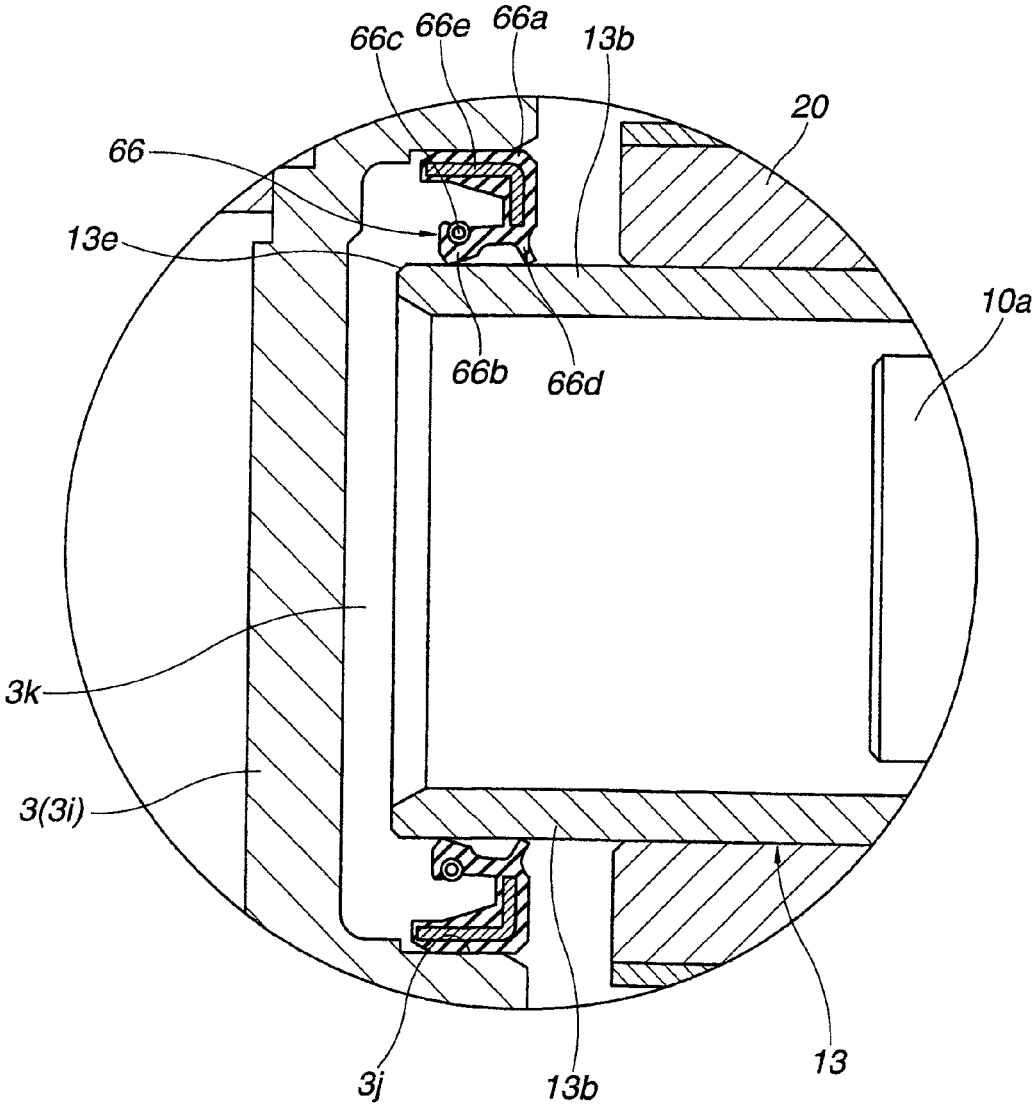
FIG. 8 is an enlarged sectional view of a part, which is a main part of the present invention, of the variable valve timing control apparatus according to a second embodiment.
Figure 9:
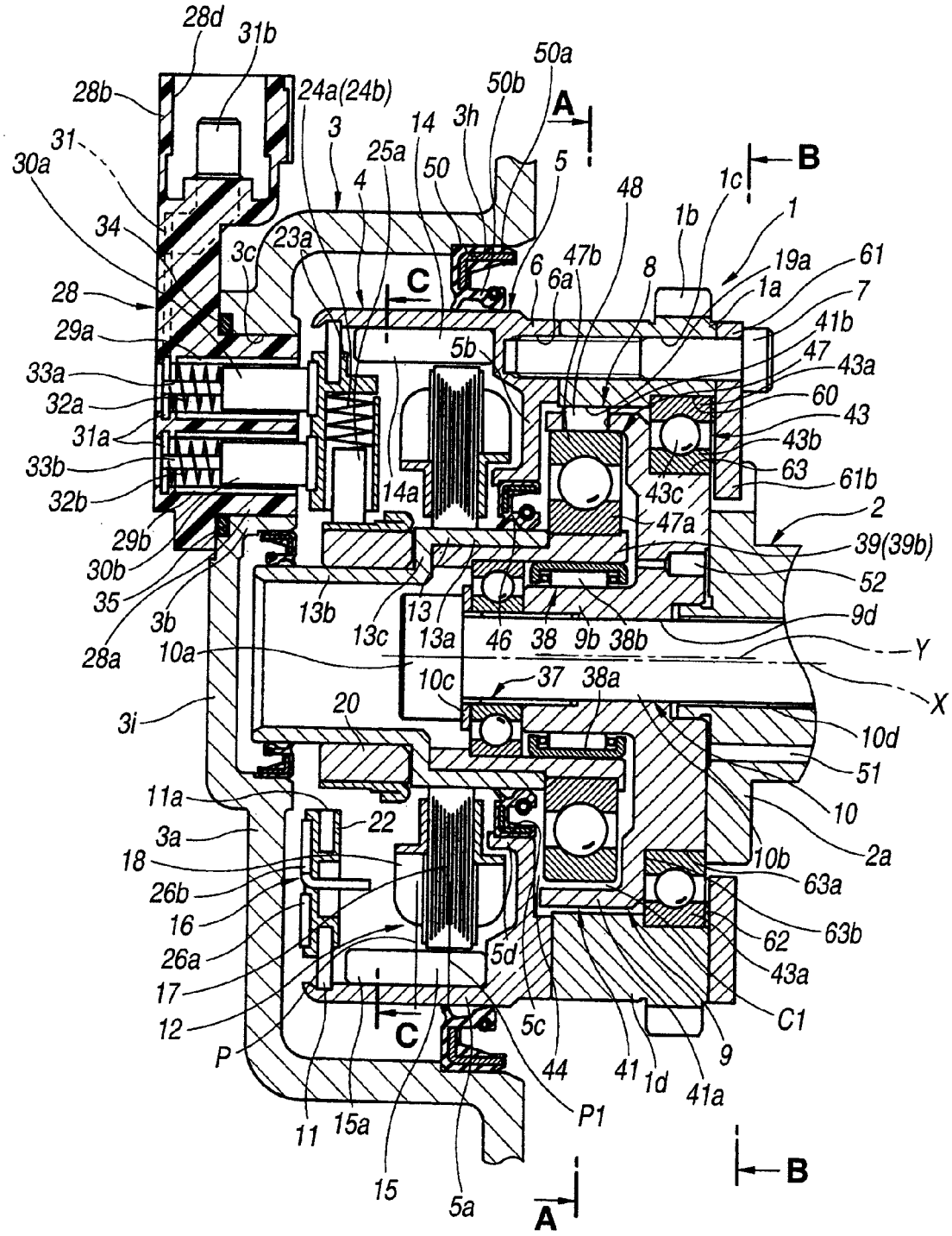
FIG. 9 is a longitudinal cross section of the variable valve timing control apparatus of the second embodiment.

FIGS. 8 and 9 show a second embodiment. As shown in FIG. 9, a basic structure of the second embodiment is the same as the first embodiment. However, in the second embodiment, as shown in FIG. 8, instead of the first oil seal 65 of the first embodiment, a large diameter first oil seal 66 that is the ring-shaped member is provided between the outer peripheral side of the top end portion of the motor drive shaft 13 and the cover member 3.

That is, a cylindrical second bulging portion 3*i* having a stepped shaped and further extending outwards is formed in a substantially middle of the bulging portion 3*a* of the cover member 3. The second bulging portion 3*i* is provided with a stepped ring-shaped inner peripheral surface 3*j*. The top end portion of the small diameter portion 13*b* of the motor drive shaft 13 which is fitted into the first oil seal 66 is located in the second bulging portion 3*i*.

The first oil seal 66 whose base material is rubber has an almost square bracket ("]") shape in cross section. The first oil seal 66 has an outer peripheral base portion 66*a*, an elastic seal portion 66*b*, a backup ring 66*c* and a seal lip 66*d*. The outer peripheral base portion 66*a* is press-fixed to an inner periphery of the inner peripheral surface 3*j* of the second bulging portion 3*i*. The elastic seal portion 66*b* is formed integrally with an inner periphery of a rear side edge of the outer peripheral base portion 66*a*, and slidably makes elastic contact with the outer peripheral surface of the small diameter portion 13*b*. The backup ring 66*c* forces the elastic seal portion 66*b* toward the outer peripheral surface of the small diameter portion 13*b*. The seal lip 66*d* is formed integrally with a rear edge outer periphery of the elastic seal portion 66*b*, and makes elastic contact with the outer peripheral surface of the small diameter portion 13*b*. Further, a core metal 66*e* is embedded in the outer peripheral base portion 66*a*.

Further, a chamfered tapered surface 13*e* is formed at a top end outer peripheral edge of the small diameter portion 13*b* of the motor drive shaft 13.

Upon the assembly of each component, the outer peripheral base portion 66*a* of the first oil seal 66 is previously press-fitted and fixed to the inner peripheral surface 3*j* of the second bulging portion 3*i* of the cover member 3. Further, when the cover member 3 is fixed to the engine, the elastic seal portion 66*b* is elastically slid to the outer peripheral surface of the small diameter portion 13*b* of the motor drive shaft 13 with the top end tapered surface 13*e* being a guide, then finally, the whole of the first oil seal 66 is fitted and positioned between the outer peripheral side of the top end portion of the motor drive shaft 13 and the cover member 3.

The first oil seal 66 (the elastic seal portion 66*b*) gives a rotational load to the motor drive shaft 13 by a frictional resistance (a frictional drag) with the first oil seal 66 (the elastic seal portion 66*b*) making sliding contact with the outer peripheral surface of the small diameter portion 13*b* of the rotating motor drive shaft 13.

Also in this embodiment, as same as the first embodiment, since the top end portion (the small diameter portion 13*b*) of the motor drive shaft 13 of the electric motor 12 is elastically supported by the cover member 3 through the first oil seal 66, vibrations of whole of the apparatus in the radial direction can be suppressed. It is therefore possible to achieve a stable and good contact state between the power-feed brushes 30*a*, 30*b* and the slip rings 26*a*, 26*b*.

In particular, the first oil seal 66 has a larger diameter than that of the first embodiment, and supports the outer periphery of the small diameter portion 13*b*. Because of the high rigidity or high solidity for supporting the motor drive shaft 13, the vibration of the apparatus can be effectively suppressed.

Further, the first oil seal 66 also has the function of sealing that suppresses the leakage of the lubricating oil flowing into an inside 3*k* of the second bulging portion 3*i* from the inside of the small diameter portion 13*b* of the motor drive shaft 13 toward electric equipment or element such as the first and second brushes 25*a*, 25*b* and 30*a*, 30*b*. It is thus possible to suppress adhesion or deposition of contaminants such as metal powder included in the lubricating oil to or between each brush, the commutator 20 and the slip rings 26*a*, 26*b*.

Furthermore, the first oil seal 66 is set between the cover member 3 that is the fixed side and the motor drive shaft 13 that is the rotation side. Thus, while the apparatus is rotating, the first oil seal 66 always gives the frictional resistance (the frictional drag) to the motor drive shaft 13. The rotational load by the frictional drag is small, yet the first oil seal 66 gives this small or slight rotational load to the motor drive shaft 13.

Consequently, as described above, since it is possible for the motor drive shaft 13 to rotate with delay with respect to the rotation of the timing sprocket 1 by the frictional drag at the engine restart, the relative rotational phase of the driven member 9 through the speed reduction mechanism 8 can be automatically returned to the advanced angle side that is suitable for the engine restart. Also the conversion response to the advanced angle side can be improved.

The present invention is not limited to the structure or configuration of the above embodiments. In the embodiments, the oil seals 65 and 66 are used as the ring-shaped member. However, instead of these oil seals, an element that elastically supports the motor drive shaft 13 in the radial direction could be provided. For instance, a plurality of arc rubber members are arranged at a certain intervals in the circumferential direction and formed into a ring-shape.

Further, although the oil seals 65 and 66 are fixed to the cover member 3 side, they could be fixed to the motor drive shaft 13 side.

Furthermore, as a mechanism that gives the frictional drag, i.e. the rotational load, to the motor drive shaft 13, besides the oil seal, for instance, a synthetic resin ring-shaped member is cut in half, and these two arc-shaped cut members are arranged on opposite sides of the motor drive shaft 13. Then, a spring member forces each inner peripheral surface of the arc-shaped cut members toward an outer peripheral surface of the motor drive shaft 13. That is, the arc-shaped cut members give the rotational load to the motor drive shaft 13 by this spring force of the spring member.

In addition, as the other means, the above ring-shaped member is cut in half and the two arc-shaped cut members are formed by magnet, then these cut members are arranged on opposite sides of the motor drive shaft 13 with a certain air gap provided between opposing inner peripheral surfaces of the cut members and the outer peripheral surface of the motor drive shaft 13. That is, the cut members give the rotational load to the motor drive shaft 13 by a magnetic force.

From the foregoing, the present invention includes the following structure or configuration of the variable valve timing control apparatus, and has the following effects.

(a) In the variable valve timing control apparatus of an internal combustion engine, the speed reduction mechanism is supplied with lubricating oil, and the ring-shaped member has a sealing function that prevents leakage of the lubricating oil from the speed reduction mechanism into an inside of the electric motor.

(b) In the variable valve timing control apparatus, the cover member covers the front end part of the housing and at least a part of an outer circumferential surface of the housing, and the variable valve timing control apparatus further has a second ring-shaped member which is disposed at either one of the outer circumferential surface of the housing and an inner circumferential surface of the cover member and slidably makes elastic contact with the other of the outer circumferential surface of the housing and the inner circumferential surface of the cover member throughout an entire circumference of the circumferential surface.

(c) In the variable valve timing control apparatus, the drive rotary member has a sprocket to which rotation is transmitted from the engine crankshaft through a chain, and the second ring-shaped member functions as a seal which suppresses leakage of the lubricating oil that is supplied to the sprocket to the front end part side of the to housing.

(d) In the variable valve timing control apparatus, the power feed mechanism is placed in a space defined by the ring-shaped member and the second ring-shaped member.

According to the above inventions, it is possible to suppress adhesion or deposition of contaminants such as metal powder included in the lubricating oil to or in the power feed mechanism.

(e) In the variable valve timing control apparatus, the driven rotary member is fixed to the camshaft with a cam bolt that is inserted in a rotation center of the driven rotary member from an axial direction.

(f) In the variable valve timing control apparatus, the motor drive shaft is formed into a hollow cylindrical shape. The cover member has a protuberance at an opposing position to a top end portion of the motor drive shaft, and at least a top end portion of the protuberance is inserted into the top end portion of the motor drive shaft. The ring-shaped member is set between an outer periphery of the protuberance and an inner periphery of the motor drive shaft.

(g) In the variable valve timing control apparatus, the protuberance is formed integrally with the cover member.

(h) In the variable valve timing control apparatus, an inner peripheral portion of the ring-shaped member is fixed to the outer periphery of the protuberance, and an outer peripheral portion of the ring-shaped member makes sliding contact with an inner peripheral surface of the motor drive shaft.

According to the above inventions, by previously fixing the ring-shaped member to the protuberance of the cover member, for instance, when fixing the driven rotary member to the camshaft with the cam bolt, the ring-shaped member can be installed inside the motor drive shaft using the protuberance at the same time when fixing the cover member to the engine after inserting the cam bolt to the inside of the motor drive shaft and screwing the cam bolt. Thus, a series of these assembly can easily be done.

(i) In the variable valve timing control apparatus, a tapered surface whose diameter becomes wider in an outward direction is formed at a top end inner peripheral edge of the top end portion of the motor drive shaft.

According to the above invention, when inserting the ring-shaped member previously fixed at the outer periphery of the protuberance into the motor drive shaft from the top end portion of the motor drive shaft, the tapered surface serves as the insertion guide. The workability of insertion of the outer peripheral portion of the ring-shaped member can be improved, and damage to the motor drive shaft, the ring-shaped member, the cover member etc. can be prevented.

(j) In the variable valve timing control apparatus, the cover member has a recessed portion at an opposing position to a top end portion of the motor drive shaft. The top end portion of the motor drive shaft is inserted and fitted in the recessed portion through the ring-shaped member. The ring-shaped member is set between an inner periphery of the recessed portion and an outer periphery of the top end portion of the motor drive shaft.

(k) In the variable valve timing control apparatus, an outer peripheral portion of the ring-shaped member is fixed to the inner periphery of the recessed portion, and an inner peripheral portion of the ring-shaped member makes sliding contact with an outer peripheral surface of the top end portion of the motor drive shaft.

(l) In the variable valve timing control apparatus, a tapered surface whose diameter becomes smaller toward a top edge of the top end portion is formed at a top end outer peripheral edge of the top end portion of the motor drive shaft.

(m) In the variable valve timing control apparatus, the speed reduction mechanism is configured to convert a relative rotational phase of the driven rotary member with respect to the drive rotary member to an advanced angle side by the fact that the rotation of the motor drive shaft is delayed with respect to rotation of the drive rotary member.

(n) In the variable valve timing control apparatus, open and closing timing of an engine valve is changed to a direction approaching a suitable timing for an engine start by the fact that the rotation of the motor drive shaft is delayed with respect to rotation of the drive rotary member.

(o) In the variable valve timing control apparatus, the ring-shaped member gives, by its own elastic force, a load to the motor drive shaft so that the rotation of the motor drive shaft is delayed with respect to rotation of the drive rotary member in a state in which no current is supplied to the electric motor.

(p) In the variable valve timing control apparatus, the electric motor has a magnetic material rotor provided at the motor drive shaft and having a plurality of slots in a circumferential direction, a coil wound around the slots of the rotor, a permanent magnet arranged at an inner peripheral side of the housing, which is an opposite side to the coil, and having a plurality of magnetic poles in a circumferential direction, a commutator provided at the motor drive shaft and electrically connected to the coil, and a switching brush provided in the housing and electrically making contact with the commutator.

(q) A variable valve timing control apparatus of an internal combustion engine, has:

a drive rotary member to which a turning force is transmitted from an engine crankshaft;

a driven rotary member which is fixed to a camshaft and, to which the turning force is transmitted from the drive rotary member;

a motor drive shaft which relatively rotates with respect to the drive rotary member;

a speed reduction mechanism which transmits rotation of the motor drive shaft to the driven rotary member with the rotation of the motor drive shaft reduced by relatively rotating the motor drive shaft with respect to the drive rotary member;

an electric motor which relatively rotates the motor drive shaft with respect to the drive rotary member by application of power;

a housing which is connected integrally with the drive rotary member and houses therein the electric motor;

a cover member which is fixed to the engine so as to cover at least a front end part of the housing;

a power feed mechanism which feeds the power to the electric motor, the power feed mechanism having:

(a) a slip ring disposed at either one of the housing front end and the cover member; and (b) a power-feed brush disposed at the other of the housing front end and the cover member and touching the slip ring; and a ring-shaped member which is arranged at outer peripheral side of the motor drive shaft, and wherein, the ring-shaped member is cut in half and these two arc-shaped cut members are arranged on opposite sides of the motor drive shaft, and a spring member forces each inner peripheral surface of the arc-shaped cut members toward an outer peripheral surface of the motor drive shaft.

(r) A variable valve timing control apparatus of an internal combustion engine, has:

a drive rotary member to which a turning force is transmitted from an engine crankshaft;

a driven rotary member which is fixed to a camshaft and, to which the turning force is transmitted from the drive rotary member;

a motor drive shaft which relatively rotates with respect to the drive rotary member;

a speed reduction mechanism which transmits rotation of the motor drive shaft to the driven rotary member with the rotation of the motor drive shaft reduced by relatively rotating the motor drive shaft with respect to the drive rotary member;

an electric motor which relatively rotates the motor drive shaft with respect to the drive rotary member by application of power;

a housing which is connected integrally with the drive rotary member and houses therein the electric motor;

a cover member which is fixed to the engine so as to cover at least a front end part of the housing;

a power feed mechanism which feeds the power to the electric motor, the power feed mechanism having:

(a) a slip ring disposed at either one of the housing front end and the cover member; and (b) a power-feed brush disposed at the other of the housing front end and the cover member and touching the slip ring; and a ring-shaped member which is arranged at outer peripheral side of the motor drive shaft, and wherein, the ring-shaped member is cut in half and these two arc-shaped cut members are formed by magnet, and these cut members are arranged on opposite sides of the motor drive shaft with a certain air gap provided between opposing inner peripheral surfaces of the cut members and an outer peripheral surface of the motor drive shaft.

According to the above inventions, in a case where no current is supplied to the electric motor, the rotational load is given to the motor drive shaft by the cut members of the ring-shaped member. Thus when the drive rotary member rotates, the motor drive shaft is delayed with respect to the drive rotary member, then the relative rotational phase angle of the driven rotary member with respect to the drive rotary member is shifted to the advanced angle side.

The entire contents of Japanese Patent Application No. 2011-127244 filed on Jun. 7, 2011 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve timing control apparatus of an internal combustion engine, comprising:

a drive rotary member to which a turning force is transmitted from an engine crankshaft;

a driven rotary member which is fixed to a camshaft and, to which the turning force is transmitted from the drive rotary member;

an electric motor which relatively rotates a motor drive shaft with respect to the drive rotary member by application of power;

a speed reduction mechanism which transmits rotation of the motor drive shaft to the driven rotary member with the rotation of the motor drive shaft reduced by relatively rotating the motor drive shaft with respect to the drive rotary member;

a housing which is connected integrally with the drive rotary member and houses therein the electric motor;

a cover member which is fixed to the engine so as to cover at least a front end part of the housing;

a power feed mechanism which feeds the power to the electric motor, the power feed mechanism having:

(a) a slip ring disposed at either one of the housing front end and the cover member; and (b) a power-feed brush disposed at the other of the housing front end and the cover member and touching the slip ring; and a ring-shaped member which is fixed to either one side of the cover member and the motor drive shaft and makes sliding contact with the other side of the cover member and the motor drive shaft.

2. The variable valve timing control apparatus of the internal combustion engine as claimed in claim 1, wherein:

the speed reduction mechanism is supplied with lubricating oil, and the ring-shaped member has a sealing function that prevents leakage of the lubricating oil from the speed reduction mechanism into an inside of the electric motor.

3. The variable valve timing control apparatus of the internal combustion engine as claimed in claim 2, wherein:

the cover member covers the front end part of the housing and at least a part of an outer circumferential surface of the housing, and the variable valve timing control apparatus further comprises:

a second ring-shaped member which is disposed at either one of the outer circumferential surface of the housing and an inner circumferential surface of the cover member and slidably makes elastic contact with the other of the outer circumferential surface of the housing and the inner circumferential surface of the cover member throughout an entire circumference of the circumferential surface.

4. The variable valve timing control apparatus of the internal combustion engine as claimed in claim 3, wherein:

the drive rotary member has a sprocket to which rotation is transmitted from the engine crankshaft through a chain, and the second ring-shaped member functions as a seal which suppresses leakage of the lubricating oil that is supplied to the sprocket to the front end part side of the housing.

5. The variable valve timing control apparatus of the internal combustion engine as claimed in claim 4, wherein:

the power feed mechanism is placed in a space defined by the ring-shaped member and the second ring-shaped member.

6. The variable valve timing control apparatus of the internal combustion engine as claimed in claim 1, wherein:

the driven rotary member is fixed to the camshaft with a cam bolt that is inserted in a rotation center of the driven rotary member from an axial direction.

7. The variable valve timing control apparatus of the internal combustion engine as claimed in claim 1, wherein:

the motor drive shaft is formed into a hollow cylindrical shape, the cover member has a protuberance at an opposing position to a top end portion of the motor drive shaft, and at least a top end portion of the protuberance is inserted into the top end portion of the motor drive shaft, and the ring-shaped member is set between an outer periphery of the protuberance and an inner periphery of the motor drive shaft.

8. The variable valve timing control apparatus of the internal combustion engine as claimed in claim 7, wherein:

the protuberance is formed integrally with the cover member.

9. The variable valve timing control apparatus of the internal combustion engine as claimed in claim 7, wherein:

an inner peripheral portion of the ring-shaped member is fixed to the outer periphery of the protuberance, and an outer peripheral portion of the ring-shaped member makes sliding contact with an inner peripheral surface of the motor drive shaft.

10. The variable valve timing control apparatus of the internal combustion engine as claimed in claim 9, wherein:

a tapered surface whose diameter becomes wider in an outward direction is formed at a top end inner peripheral edge of the top end portion of the motor drive shaft.

11. The variable valve timing control apparatus of the internal combustion engine as claimed in claim 1, wherein:

the cover member has a recessed portion at an opposing position to a top end portion of the motor drive shaft, the top end portion of the motor drive shaft is inserted and fitted in the recessed portion through the ring-shaped member, and the ring-shaped member is set between an inner periphery of the recessed portion and an outer periphery of the top end portion of the motor drive shaft.

12. The variable valve timing control apparatus of the internal combustion engine as claimed in claim 11, wherein:

an outer peripheral portion of the ring-shaped member is fixed to the inner periphery of the recessed portion, and an inner peripheral portion of the ring-shaped member makes sliding contact with an outer peripheral surface of the top end portion of the motor drive shaft.

13. The variable valve timing control apparatus of the internal combustion engine as claimed in claim 12, wherein:

a tapered surface whose diameter becomes smaller toward a top edge of the top end portion is formed at a top end outer peripheral edge of the top end portion of the motor drive shaft.

14. The variable valve timing control apparatus of the internal combustion engine as claimed in claim 1, wherein:

the speed reduction mechanism is configured to convert a relative rotational phase of the driven rotary member with respect to the drive rotary member to an advanced angle side by the fact that the rotation of the motor drive shaft is delayed with respect to rotation of the drive rotary member.

15. The variable valve timing control apparatus of the internal combustion engine as claimed in claim 1, wherein:

open and closing timing of an engine valve is changed to a direction approaching a suitable timing for an engine start by the fact that the rotation of the motor drive shaft is delayed with respect to rotation of the drive rotary member.

16. The variable valve timing control apparatus of the internal combustion engine as claimed in claim 1, wherein:

the ring-shaped member gives, by its own elastic force, a load to the motor drive shaft so that the rotation of the motor drive shaft is delayed with respect to rotation of the drive rotary member in a state in which no current is supplied to the electric motor.

17. The variable valve timing control apparatus of the internal combustion engine as claimed in claim 1, wherein:

the electric motor has a magnetic material rotor provided at the motor drive shaft and having a plurality of slots in a circumferential direction;

a coil wound around the slots of the rotor;

a permanent magnet arranged at an inner peripheral side of the housing, which is an opposite side to the coil, and having a plurality of magnetic poles in a circumferential direction;

a commutator provided at the motor drive shaft and electrically connected to the coil; and a switching brush provided in the housing and electrically making contact with the commutator.

18. A variable valve timing control apparatus of an internal combustion engine, comprising:

a drive rotary member to which a turning force is transmitted from an engine crankshaft;

a driven rotary member which is fixed to a camshaft and, to which the turning force is transmitted from the drive rotary member;

an electric motor which converts a relative rotational phase of the driven rotary member with respect to the drive rotary member by application of power;

a housing which is connected integrally with the drive rotary member and houses therein the electric motor;

a power feed mechanism which feeds the power to the electric motor, the power feed mechanism having:

(a) a slip ring disposed at either one of a housing front end part and a non-rotating member that faces to the housing front end part; and (b) a power-feed brush disposed at the other of the housing front end part and the non-rotating member and touching the slip ring; and a ring-shaped member which is provided at either one side of the non-rotating member and a motor drive shaft of the electric motor relatively rotating with respect to the housing and makes sliding contact with the other side of the non-rotating member and the motor drive shaft while elastically pressing the other side.

* * * * *